US006796820B2

(12) United States Patent
Jazowski et al.

(10) Patent No.: US 6,796,820 B2
(45) Date of Patent: Sep. 28, 2004

(54) ELECTRICAL CONNECTOR INCLUDING COLD SHRINK CORE AND THERMOPLASTIC ELASTOMER MATERIAL AND ASSOCIATED METHODS

(75) Inventors: Roy E. Jazowski, Port Orange, FL (US); Matthew D. Cawood, De Leon Springs, FL (US)

(73) Assignee: Homac Mfg. Company, Ormond Beach, FL (US)

( * ) Notice: Subject to any disclaimer, the term of this patent is extended or adjusted under 35 U.S.C. 154(b) by 0 days.

(21) Appl. No.: 10/438,775

(22) Filed: May 15, 2003

(65) Prior Publication Data

US 2003/0228779 A1 Dec. 11, 2003

Related U.S. Application Data

(60) Provisional application No. 60/380,914, filed on May 16, 2002.

(51) Int. Cl.[7] ..... H01R 13/53
(52) U.S. Cl. ..... 439/181; 439/921
(58) Field of Search ..... 439/181–187, 439/921

(56) References Cited

U.S. PATENT DOCUMENTS

| | | | | |
|---|---|---|---|---|
| 3,306,879 A | | 2/1967 | Pattison | 260/77.5 |
| 3,343,153 A | | 9/1967 | Waehner | |
| 3,390,331 A | | 6/1968 | Brown et al. | |
| 3,576,493 A | | 4/1971 | Tachick et al. | 324/133 |
| 3,697,932 A | * | 10/1972 | Keto et al. | 439/183 |
| 3,723,270 A | | 3/1973 | Tabata et al. | 204/159 |
| 3,735,025 A | | 5/1973 | Ling et al. | 174/120 |
| 3,736,505 A | | 5/1973 | Sankey | 324/133 |
| 3,933,773 A | | 1/1976 | Foerster | 260/87.5 |
| 3,951,871 A | | 4/1976 | Lloyd et al. | 252/511 |
| 3,992,567 A | | 11/1976 | Malla | 174/73 |
| 4,053,702 A | | 10/1977 | Erickson et al. | 174/73 |
| 4,222,625 A | | 9/1980 | Reed | 339/143 |
| 4,363,842 A | | 12/1982 | Nelson | 428/36 |
| 4,383,131 A | | 5/1983 | Clabburn | 174/73 |
| 4,629,277 A | | 12/1986 | Boettcher et al. | 339/111 |
| 4,675,475 A | | 6/1987 | Bortner et al. | 174/113 |
| 4,738,318 A | | 4/1988 | Boettcher et al. | 174/73 |

(List continued on next page.)

OTHER PUBLICATIONS

The Technical Service Magazine for the Rubber Industry, vol. 227, No. 3 on "Overmolding of TPEs Molding TSEs and TPEs, Solid $CO_2$ Pellet Blasting of Molds", Dec. 2002, features 24, 27 and 33.

Advanced Elastomer Systems, Trends in Plastics, ©Plastics Trends 2000–2002, "It Seals, Feels, Flexes, and is called Thermoplastic Elastomer", May 2000.

Ensto Connector OY, Finland published by The Website for the Airport Industry on "Ensto Connector OY—AGL Series Transformers, Primary and Secondary Connectors and Cable Assemblies for Airfield Lighting Markets", pp. 1–3, Jul. 17, 2002.

*Primary Examiner*—Gary Paumen
(74) *Attorney, Agent, or Firm*—Allen, Dyer, Doppelt, Milbrath & Gilchrist, P.A.

(57) ABSTRACT

An electrical connector includes a connector body having a passageway therethrough. The connector body may include a first layer adjacent the passageway, a second layer surrounding the first layer, and a third layer surrounding the second layer. At least one of the layers may include a thermoplastic elastomer (TPE) material. The connector may also include a cold shrink core within at least a portion of the passageway. The cold shrink core may include a carrier and a release member connected thereto so that the carrier maintains adjacent connector portions in an expanded state, such as to permit insertion of an electrical conductor. The release member can then be activated, such as pulling, to remove the cold shrink core so that the connector closes upon the electrical conductor.

41 Claims, 7 Drawing Sheets

U.S. PATENT DOCUMENTS 4,758,171 A * 7/1988 Hey ..... 439/181
4,847,450 A 7/1989 Rupprecht ..... 174/143
4,904,932 A 2/1990 Schweitzer, Jr. ..... 324/133
4,946,393 A 8/1990 Borgstrom et al. ..... 439/88
5,080,942 A 1/1992 Yau ..... 428/349
5,215,475 A 6/1993 Stevens ..... 439/206
5,230,640 A 7/1993 Tardif ..... 439/578
5,421,750 A 6/1995 Crotty ..... 439/801
5,486,388 A 1/1996 Portas et al. ..... 428/34.9
5,492,740 A 2/1996 Vallauri et al. ..... 428/34.9
5,573,410 A 11/1996 Stepniak ..... 439/88
5,641,306 A 6/1997 Stepniak ..... 439/491
5,795,180 A 8/1998 Siebens ..... 439/489
5,801,332 A 9/1998 Berger et al. ..... 174/73.1
5,804,630 A 9/1998 Heyer et al. ..... 524/436
5,844,170 A 12/1998 Chor et al. ..... 174/74
5,846,093 A 12/1998 Muench, Jr. et al. ..... 439/89
5,857,862 A 1/1999 Muench et al. ..... 439/181
5,957,712 A 9/1999 Stepniak ..... 439/187
6,015,629 A 1/2000 Heyer et al. ..... 426/625
6,106,954 A 8/2000 Meguriya et al. ..... 428/447
6,124,549 A 9/2000 Kemp et al. ..... 174/73.1
6,168,447 B1 1/2001 Stepniak et al. ..... 439/187
6,213,799 B1 4/2001 Jazowski et al. ..... 439/181
6,227,908 B1 * 5/2001 Aumeier et al. ..... 439/607
6,338,637 B1 1/2002 Muench, Jr. et al. ..... 439/201
6,340,794 B1 1/2002 Wandmacher et al. ..... 174/73.1
2002/0055290 A1 5/2002 Jazowski et al. ..... 439/187
2002/0055567 A1 5/2002 Romenesko et al. ..... 524/261

* cited by examiner-

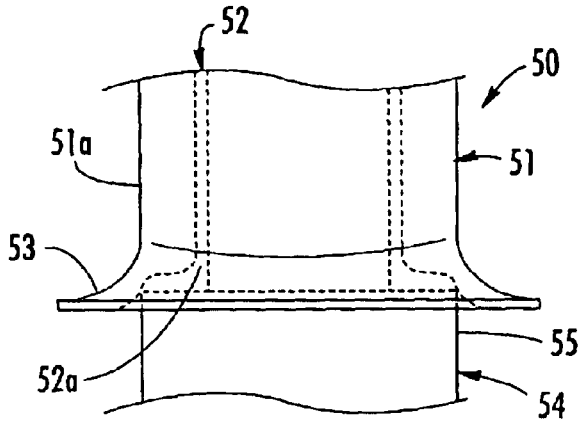
FIG.7
FIG.8
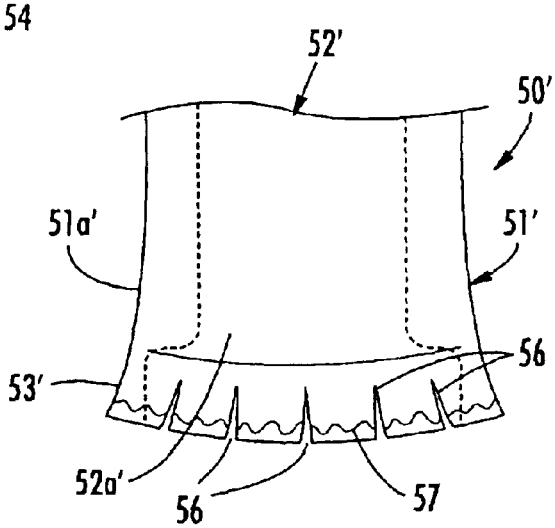
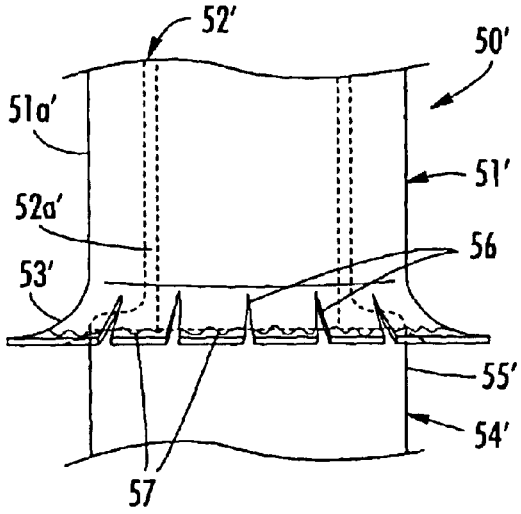
FIG.9
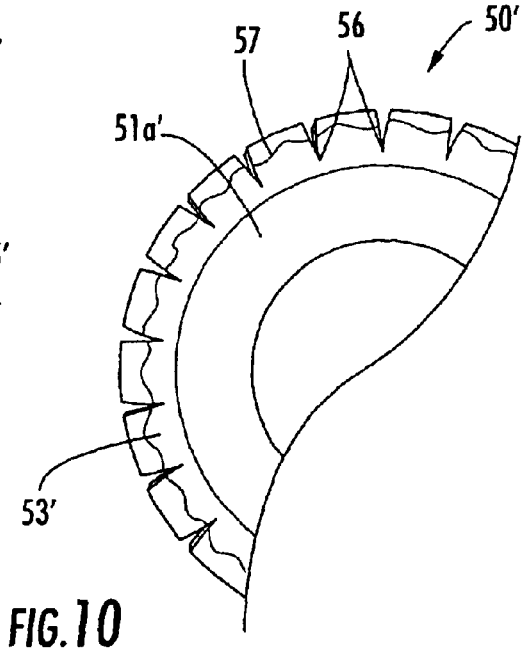
FIG.10

ELECTRICAL CONNECTOR INCLUDING COLD SHRINK CORE AND THERMOPLASTIC ELASTOMER MATERIAL AND ASSOCIATED METHODS

RELATED APPLICATION

This application is based upon prior filed copending provisional application Serial No. 60/380,914 filed May 16, 2002, the entire subject matter of which is incorporated herein by reference in its entirety.

FIELD OF THE INVENTION

The present invention relates to electrical products, and more particularly, to electrical connectors for electrical systems and associated methods.

BACKGROUND OF THE INVENTION

An electrical distribution system typically includes distribution lines or feeders that extend out from a substation transformer. The substation transformer is typically connected to a generator via electrical transmission lines.

Along the path of a feeder, one or more distribution transformers may be provided to further step down the distribution voltage for a commercial or residential customer. The distribution voltage range may be from 5 through 46 kV, for example. Various connectors are used throughout the distribution system. In particular, the primary side of a distribution transformer typically includes a transformer bushing to which a bushing insert is connected. In turn, an elbow connector may be removably coupled to the bushing insert. The distribution feeder is also fixed to the other end of the elbow connector. Of course, other types of connectors are also used in a typical electrical power distribution system. For example, the connectors may be considered as including other types of removable connectors, as well as fixed splices and terminations. Large commercial users may also have a need for such high voltage connectors.

One particular difficulty with conventional elbow connectors, for example, is that they use curable materials. For example, such a connector may typically be manufactured by molding the inner semiconductive layer first, then the outer semiconductive jacket (or vise-versa). These two components are placed in a final insulation press and then insulation layer is injected between these two semiconductive layers. Accordingly, the manufacturing time is relatively long, as the materials need to be allowed to cure during manufacturing. In addition, the conventional EPDM materials used for such elbow connectors and their associated bushing inserts, may have other shortcomings as well.

One typically desired feature of an elbow connector is the ability to readily determine if the circuit in which the connector is coupled is energized. Accordingly, voltage test points have been provided on such connectors. For example, U.S. Pat. No. 3,390,331 to Brown et al. discloses an elbow connector including an electrically conductive electrode embedded in the insulator in spaced relation from the interior conductor. The test point will rise to a voltage if the connector is energized. U.S. Pat. No. 3,736,505 to Sankey; U.S. Pat. No. 3,576,493 to Tachick et al.; U.S. Pat. No. 4,904,932 to Schweitzer, Jr.; and U.S. Pat. No. 4,946,393 to Borgstrom et al. disclose similar test points for an elbow connector. Such voltage test points may be somewhat difficult to fabricate, and upon contamination and repeated use, they may become less accurate and less reliable.

An elbow connector typically includes a connector body having a passageway with a bend therein. A semiconductive EPDM material defines an inner layer at the bend in the passageway. An insulative EPDM second layer surrounds the first layer, and a third semiconductive EPDM layer or outer shield surrounds the second insulative layer. A first end of the passageway is enlarged and carries an electrode or probe that is matingly received in the bushing insert. A second end of the passageway receives the end of the electrical conductor. The second connector end desirably seals tightly against the electrical conductor or feeder end. Accordingly, another potential shortcoming of such an elbow connector is the difficulty in manually pushing the electrical conductor into the second end of the connector body.

In an attempt to address the difficulty of inserting the electrical connector into the second connector end, U.S. Pat. No. 4,629,277 to Boettcher et al. discloses an elbow connector including a heat shrinkable tubing integral with an end for receiving an electrical conductor. Accordingly, the conductor end can be easily inserted into the expanded tube, and the tube heated to shrink and seal tightly against the conductor. U.S. Pat. No. 4,758,171 to Hey applies a heat shrink tube to the cable end prior to push-fitting the cable end into the body of the elbow connector.

U.S. Pat. No. 5,230,640 to Tardif discloses an elbow connector including a cold shrink core positioned in the end of an elbow connector comprising EPDM to permit the cable to be installed and thereafter sealed to the connector body when the core is removed. However, this connector may suffer from the noted drawbacks in terms of manufacturing speed and cost. U.S. Pat. No. 5,486,388 to Portas et al.; U.S. Pat. No. 5,492,740 to Vallauri et al.; U.S. Pat. No. 5,801,332 to Berger et al.; and U.S. Pat. No. 5,844,170 to Chor et al. each discloses a similar cold shrink tube for a tubular electrical splice.

Another issue that may arise for an elbow connector is electrical stress that may damage the first or semiconductive layer. A number of patents disclose selecting geometries and/or material properties for an electrical connector to reduce electrical stress, such as U.S. Pat. No. 3,992,567 to Malia; U.S. Pat. No. 4,053,702 to Erikson et al.; U.S. Pat. No. 4,383,131 to Clabburn U.S. Pat. No. U.S. Pat. No. 4,738,318 to Boettcher et al.; U.S. Pat. No. 4,847,450 to Rupprecht, deceased; U.S. Pat. No. 5,804,630 and U.S. Pat. No. 6,015,629 to Heyer et al.; U.S. Pat. No. 6,124,549 to Kemp et al.; and U.S. Pat. No. 6,340,794 to Wandmacher et al.

For a typical 200 Amp elbow connector, the elbow cuff or outer first end is designed to go over the shoulder of the mating bushing insert and is used for containment of the arc and/or gasses produced during a load-make or load-break operation. During the past few years, the industry has identified the cause of a flashover problem which has been reoccurring at 25 kV and 35 kV. The industry has found that a partial vacuum occurs at certain temperatures and circuit conditions. This partial vacuum decreases the dielectric strength of air and the interfaces flashover when the elbow is removed from the bushing insert. Various manufacturers have attempted to address this problem by venting the elbow cuff interface area, and at least one other manufacturer has insulated all of the conductive members inside the interfaces.

U.S. Pat. No. 6,213,799 and its continuation Application No. 2002/00055290 A1 to Jazowski et al., for example, discloses an anti-flashover ring carried by the bushing insert for a removable elbow connector. The ring includes a series of passageways thereon to prevent the partial vacuum from forming during removal of the elbow connector that could otherwise cause flashover. U.S. Pat. No. 5,957,712 to Stepniak and U.S. Pat. No. 6,168,447 to Stepniak et al. also each discloses a modification to the bushing insert to include passageways to reduce flashover. Another approach to address flashover is disclosed in U.S. Pat. No. 5,846,093 to Muench, Jr. et al. that provides a rigid member in the elbow connector so that it does not stretch upon removal from the bushing insert thereby creating a partial vacuum. U.S. Pat. No. 5,857,862 to Muench, Jr. et al. discloses an elbow connector including an insert that contains an additional volume of air to address the partial vacuum creation and resulting flashover.

Yet another potential shortcoming of a conventional elbow connector, for example, is being able to visually determine whether the connector is properly seated onto the bushing insert. U.S. Pat. No. 6,213,799 and its continuation Application No. 2002/00055290 A1 to Jazowski et al., mentioned above, each discloses that the anti-flashover ring on the bushing insert is colored and serves as a visual indicator that the elbow connector is seated when the ring is obscured.

U.S. Pat. No. 5,641,306 to Stepniak discloses a separable load-break elbow connector with a series of colored bands that are obscured when received within a mating connector part to indicate proper installation. Along these lines, but relating to the electrical bushing insert, U.S. Pat. No. 5,795,180 to Siebens discloses a separable load break connector and mating electrical bushing wherein the busing includes a colored band that is obscured when the elbow connector is mated to a bushing that surrounds the removable connector.

Accordingly, there exists several significant shortcomings in conventional electrical connectors, particularly for high voltage distribution applications.

SUMMARY OF THE INVENTION

In view of the foregoing background, it is therefore an object of the invention to provide an electrical connector and associated method for making the connector, particularly for high voltage applications, that is readily installed onto an electrical conductor.

This and other objects, features and advantages in accordance with the invention are provided by an electrical connector comprising a connector body having a passageway therethrough and including a first layer adjacent the passageway, a second layer surrounding the first layer, and a third layer surrounding the second layer; wherein at least one of the layers comprises a thermoplastic elastomer (TPE) material. More particularly, the connector may also include a cold shrink core within at least a portion of the passageway. The cold shrink core may comprise a carrier and a release member connected thereto so that the carrier maintains adjacent connector portions in an expanded state, such as to permit insertion of an electrical conductor. The release member can then be activated, such as by pulling, to remove the cold shrink core so that the connector closes upon the electrical conductor. The cold shrink core may be positioned in only one end of an elbow connector, for example.

The first and third layers preferably have a relatively low resistivity, and the second layer may have a relatively high resistivity. In particular, the third layer may comprise a semiconductive TPE material, and the second layer may comprise an insulative TPE material. In some embodiments, the first layer may also comprise a semiconductive TPE material. The TPE material layers may be overmolded to thereby increase production speed and efficiency thereby lowering production costs. The TPE material may also provide excellent electrical performance.

The passageway may have first and second ends and a medial portion extending therebetween. The first layer may be positioned along the medial portion of the passageway and spaced inwardly from respective ends of the passageway. For elbows and T-connectors, the medial portion of the passageway may have a bend therein. The first end of the passageway may also have an enlarged diameter to receive an electrical bushing insert therein for some embodiments.

For other embodiments, the connector body may have a tubular shape defining the passageway. The first layer may have at least one predetermined property to reduce electrical stress. For example, the predetermined property may comprise a predetermined impedance profile. Alternately or additionally, the predetermined property may comprise a predetermined geometric configuration, such as one or more ribs extending outwardly from the bend in those embodiments including the bend.

The first layer may define an innermost layer, and the third layer may define an outermost layer. The connector may also include at least one pulling eye carried by the connector body. The connector body may be configured for at least 15KV and 200 Amp operation. Each of the first and third layers may have a resistivity less than about $10^8$ Ω·cm, and the second layer may have a resistivity greater than about $10^8$ Ω·cm.

A method aspect of the invention is for making an electrical connector body having a passageway therethrough. The method may comprise providing a first layer to define at least a medial portion of the passageway; overmolding a second layer surrounding the first layer and comprising an insulative TPE material having a relatively high resistivity; overmolding a third layer surrounding the second layer and comprising a material having a relatively low resistivity; and positioning a cold shrink core within at least a portion of the passageway. The third layer may also comprise a semiconductive TPE material, and the first layer may comprise a semiconductive TPE material in some embodiments.

BRIEF DESCRIPTION OF THE DRAWINGS

FIG. 7 is a schematic side elevational view of a first end portion of an elbow connector mated onto an electrical bushing insert in accordance with the invention.

FIG. 8 is a schematic side elevational view of a first end portion of another embodiment of the elbow connector prior to mating with an electrical bushing insert in accordance with the invention.

FIG. 9 is a schematic side elevational view of the elbow connector shown in FIG. 8 after mating with the electrical bushing insert.

FIG. 10 is a schematic top plan view of a portion of the elbow connector as shown in FIG. 9.

DETAILED DESCRIPTION OF THE PREFERRED EMBODIMENTS

The present invention will now be described more fully hereinafter with reference to the accompanying drawings in which preferred embodiments of the invention are shown. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout. Prime and multiple prime notation are used in alternate embodiments to indicate similar elements.

Figure 1:
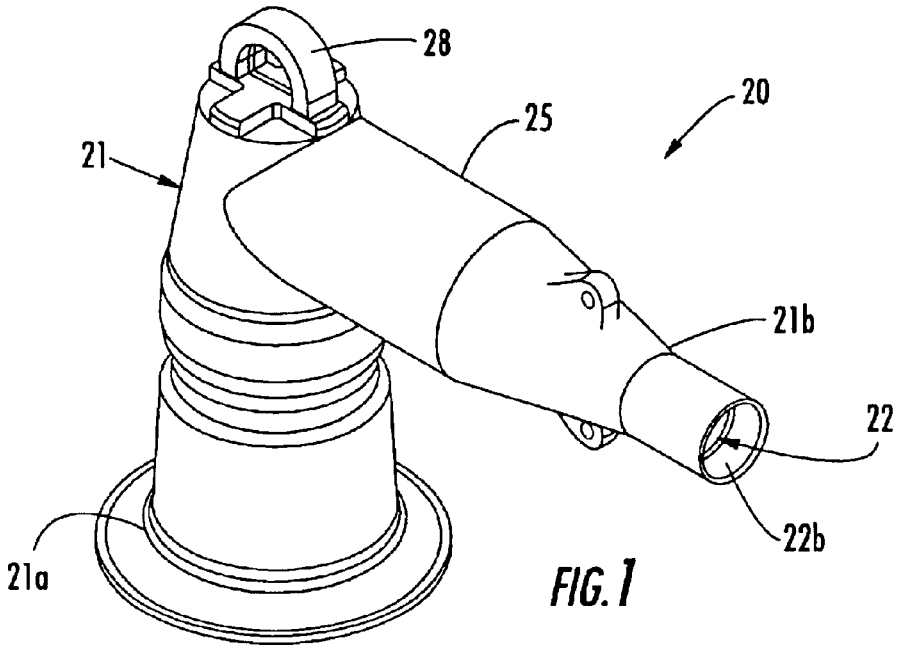
FIG. 1 is a perspective view of an elbow connector in accordance with the invention.
Figure 2:
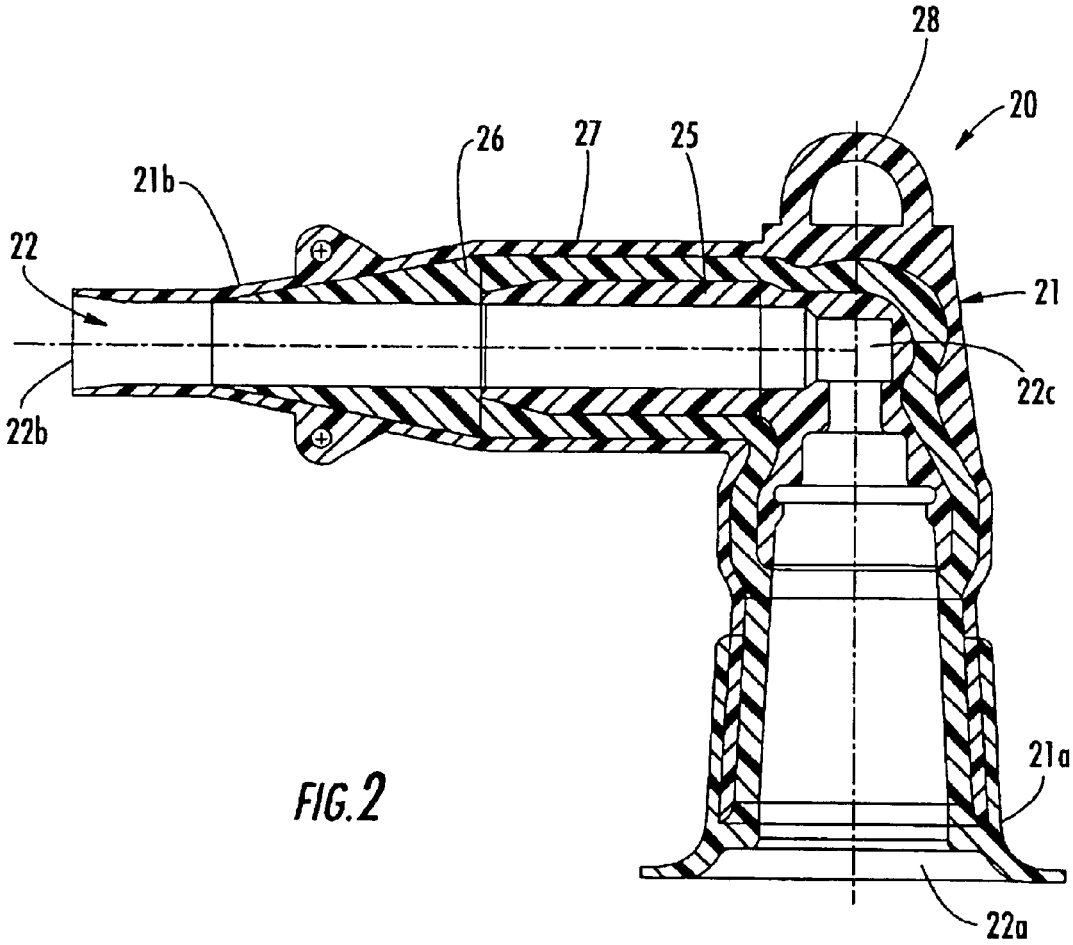
FIG. 2 is a longitudinal cross-sectional view of the elbow connector shown in FIG. 1.

Referring initially to FIGS. 1 and 2, an electrical elbow connector 20 is initially described. As will be appreciated by those skilled in the art, the elbow connector 20 is but one example of an electrical connector, such as for high voltage power distribution applications, comprising a connector body having a passageway 22 therethrough. The passageway 22 illustratively includes a first end 22*a*, a second end 22*b*, and a medial portion 22*c* having a bend therein. For clarity of explanation, the connector body 21 of the connector 20 is shown without the associated electrically conductive hardware, including the electrode or probe that would be positioned within the enlarged first end 22*a* of the passageway 22, as would be readily understood by those skilled in the art.

The connector body 21 includes a first layer 25 adjacent the passageway 22, a second layer 26 surrounding the first layer, and a third layer 27 surrounding the second layer. In accordance with one important aspect of the connector 20, at least the second layer may comprise an insulative thermoplastic elastomer (TPE) material. The first and third layers 25, 27 also preferably have a relatively low resistivity. In some embodiments, the third layer 27 may comprise a semiconductive TPE material. In addition, the first layer 25 may also comprise a semiconductive TPE material. In other embodiments, the first layer 25 may comprise another material, such as a conventional EPDM.

By using relatively new electrical grade TPE materials, such as thermoplastic olefin materials, thermoplastic polyolefin materials, thermoplastic vulcanites, and/or thermoplastic silicone materials, etc., molding can use new layer technology. This technology may include molding the first or inner semiconductive layer 25 first, then overmolding the second or insulation layer 26, and then overmolding the third or outer semiconductive shield layer 27 over the insulation layer. Some of the suppliers for such materials are: A. Schulman—Akron, Ohio; AlphaGary Corp. —Leominster, Mass.; Equistar Chemicals—Houston, Tex.; M.A. Industries, Inc.—Peachtree City, Ga.; Montrell North America—Wilmington, Del.; Network Polymers, Inc.—Akron, Ohio; Solutia, Inc.—St. Louis, Mo.; Solvay Engineering Polymers—Auburn Hills, Mich.; Teknor Aprex International—Pawtucket, R.I.; Vi-Chem Corp.—Grand Rapids, Mich.; and Dow Chemicals—Somerset, N.J. In other words, the TPE material layers may be overmolded to thereby increase production speed and efficiency thereby lowering production costs. The TPE material may also provide excellent electrical performance.

The use of a TPE material for the third layer 27 permits the entire outer portion of the connector 20 to be color coded, such as by the addition of colorants to the TPE material as will be appreciated by those skilled in the art. For example, a proposed industry standard specifies red for 15KV connectors, and blue for 25 KV connectors. Gray is another color that TPE materials may exhibit for color coding. Of course, other colors may also be used.

In the illustrated connector 20 embodiment, a first connector end 21*a* adjacent the first end 22*a* of the passageway 22 has a progressively increasing outer diameter. The second connector end 21*b* adjacent the second end 22*b* of the passageway 22 has a progressively decreasing outer diameter. As will be appreciated by those skilled in the art, other configurations of connectors ends 21*a*, 21*b* are also possible.

As illustrated, the first layer 25 defines an innermost layer, and the third layer 27 defines the outermost layer. The connector 20 also illustratively includes a pulling eye 28 carried by the connector body 21. The pulling eye 28 may have a conventional construction and needs no further discussion herein.

The connector body 21 may be configured for at least 15KV and 200 Amp operation, although other operating parameters will be appreciated by those skilled in the art. In addition, each of the first and third layers 25, 27 may have a resistivity less than about $10^8$ Ω·cm, and the second layer 26 may have a resistivity greater than about $10^8$ Ω·cm. Accordingly, the term semiconductive, as used herein, is also meant to include materials with resistivities so low, they could also be considered conductors.

Those of skill in the art will appreciate that although an elbow connector 20 is shown and described above, the features and advantages can also be incorporated into T-shaped connectors that are included within the class of removable connectors having a bend therein. This concept of overlay technology may also be used for molding a generation of insulated separable connectors, splices and terminations that may be used in the underground electrical distribution market, for example. Some of these other types of electrical connectors are described in greater detail below.

Figure 3:
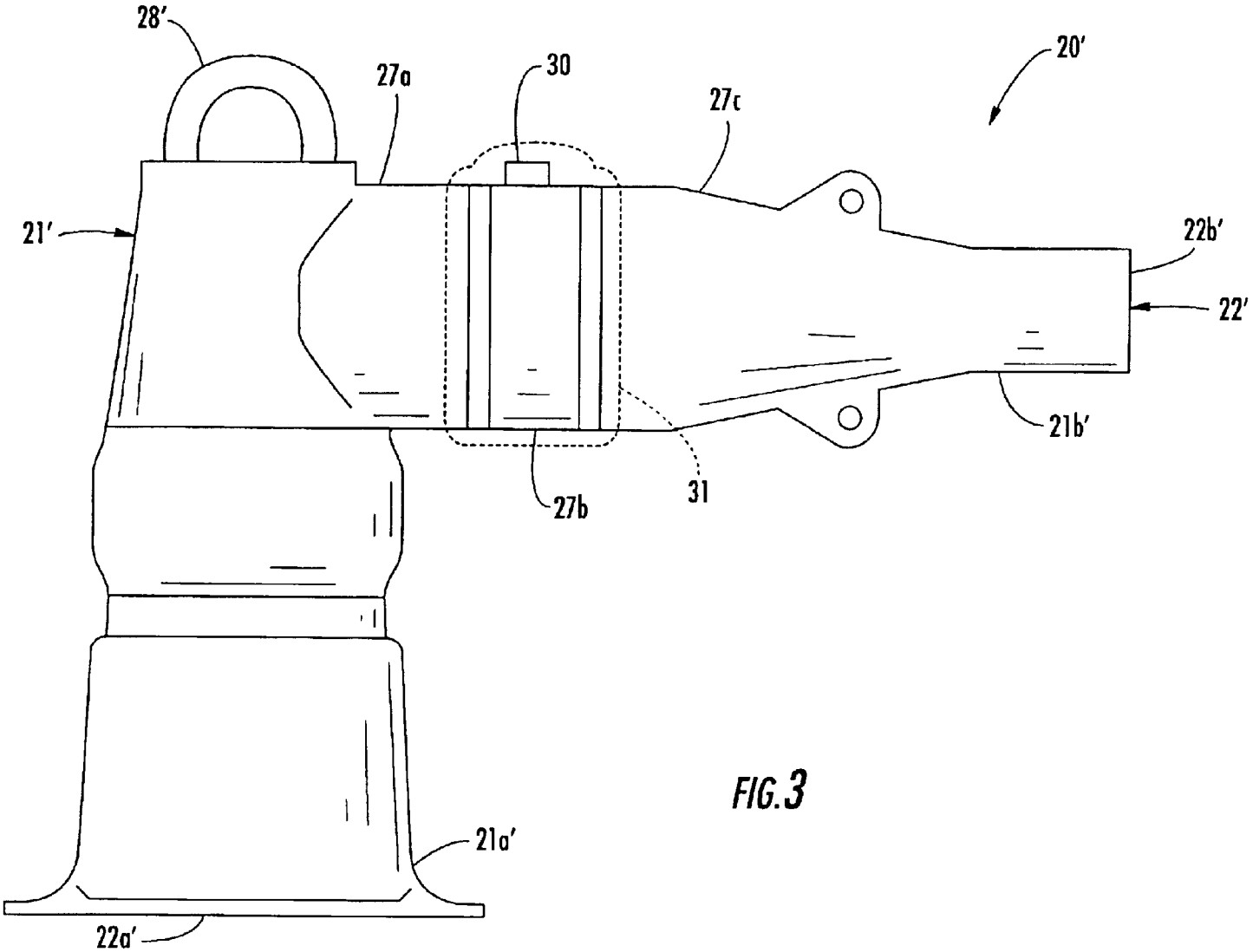
FIG. 3 is a side elevational view of an elbow connector including a split shield voltage test point in accordance with the invention.

Referring now additionally to FIG. 3, another aspect of an electrical elbow connector 20' is now described. Presently, an approach for providing a feedback voltage of a connector is derived from an elbow test point as described in the above background of the invention. As also described, sometimes such a test point can be unreliable if contaminated or wet, and the voltage can be easily saturated. The connector 20' of the invention illustratively includes a split shield 27'. In other words, the third layer 27' is arranged in three spaced apart portions with first and third portions 27*a*, 27*c* to be connected to a reference voltage so that the second portion 27*b* floats at a monitor voltage for the electrical connector 20'. In the illustrated embodiment, the second portion 27*b* of the third layer 27' has a band shape surrounding the passageway 22'. Those other elements of the connector 20' are indicated with prime notation and are similar to those elements described above with reference to FIGS. 1 and 2.

A monitor point 30 is illustratively connected to the second portion 27*b* of the third layer 27'. In addition, a cover 31 may be provided to electrically connect the first and third portions 27*a*, 27*c* of the third layer 27' yet permit access to the monitor point 30 as will be appreciated by those skilled in the art. For example, the cover 31 may have a hinged lid, not shown, to permit access to the monitor point 30, although other configurations are also contemplated.

By splitting or separating adjacent portions of the third layer 27' or outer conductive shield, a reliable voltage source can be provided that can be used to monitor equipment problems, detect energized or non-energized circuits, and/or used by fault monitoring equipment, etc. as will be appreciated by those skilled in the art. By splitting and isolating the shield at various lengths and sizes, different voltages can provide feedback to monitoring equipment. The TPE materials facilitate this split shield feature, and this feature can be used on many types of electrical connectors in addition to the illustrated elbow connector 20'.

Figure 4:
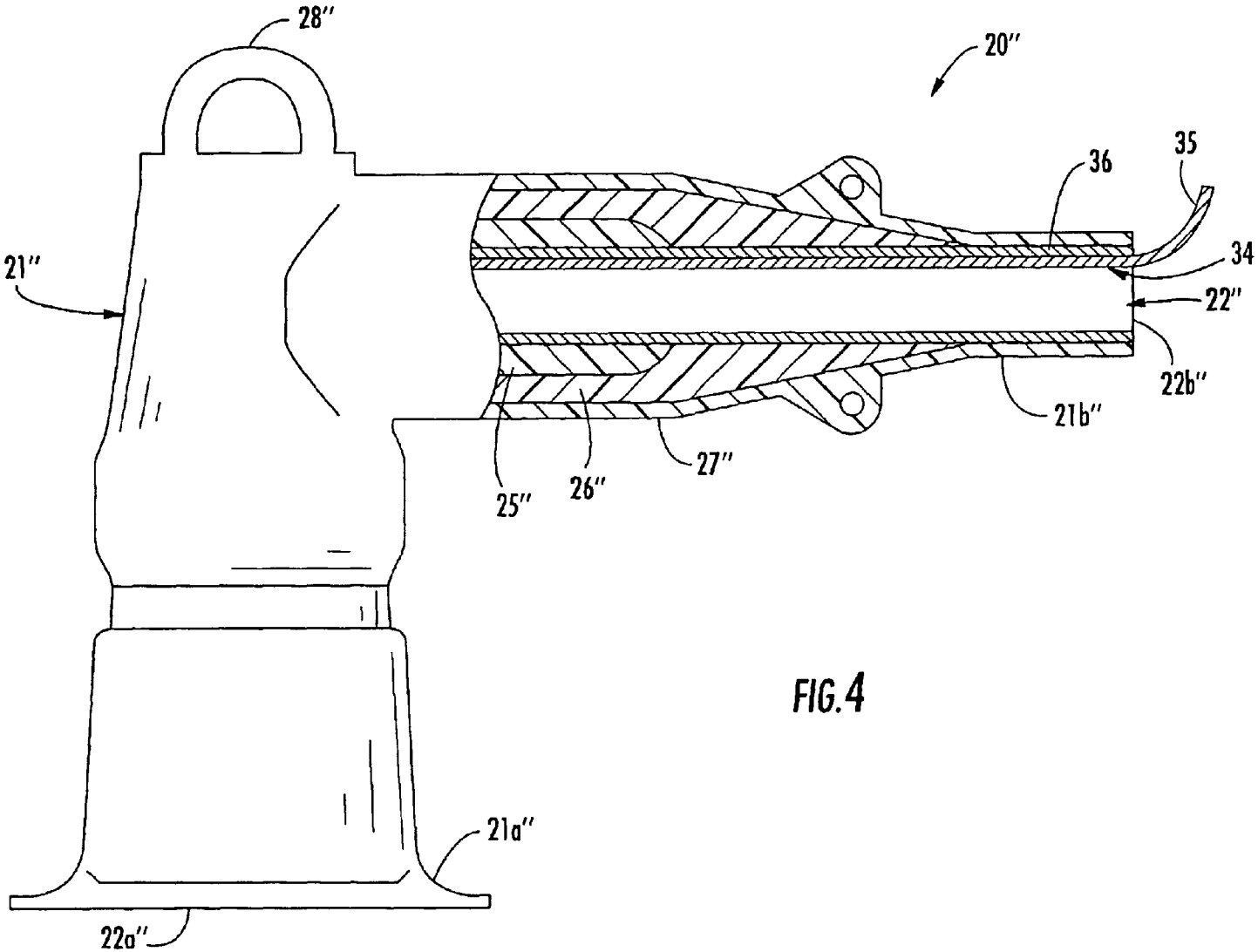
FIG. 4 is a fragmentary side elevational view of an elbow connector including a cold shrink core in accordance with the invention.

Turning now additionally to the illustrated elbow connector 20" shown in FIG. 4, another advantageous feature is now explained. As shown, a cold shrink core 34 is positioned within the second end 22*b*" of the passageway 22". Of course, in other embodiments, the cold shrink core 34 may be positioned within at least a portion of the passageway 22". The cold shrink core 34 illustratively comprises a carrier 36 and a release member 35 connected thereto so that the carrier maintains adjacent connector portions in an expanded state, such as to permit insertion of an electrical conductor, not shown. The release member 35 can then be activated, such as pulling, to remove the cold shrink core 34 so that the second connector end 21*b*" closes upon the electrical conductor.

The TPE materials facilitate molded-in cold shrink technology for separable elbow connectors 20", such as 200 and 600 Amp products, for example. Since the elbows 20" are typically mated onto 200 or 600 Amp bushing inserts, the bushing side or first end 21*a*" of the elbow need not be changed and a certain hardness/durometer and modulus can be maintained for the bushing side. But on the cable side or second end 21*b*" of the connector body 21" of the elbow connector 20", the TPE materials will allow use of cold shrink technology to initially expand the cable entrance.

Figure 5:
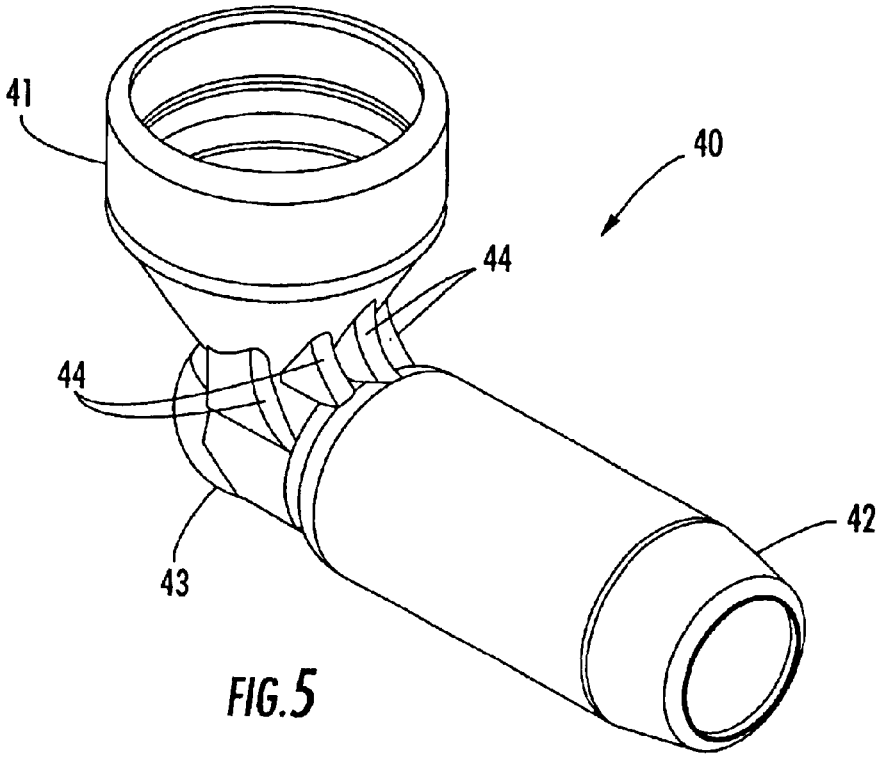
FIG. 5 is a perspective view of an embodiment of a first layer for an elbow connector of the invention.
Figure 6:
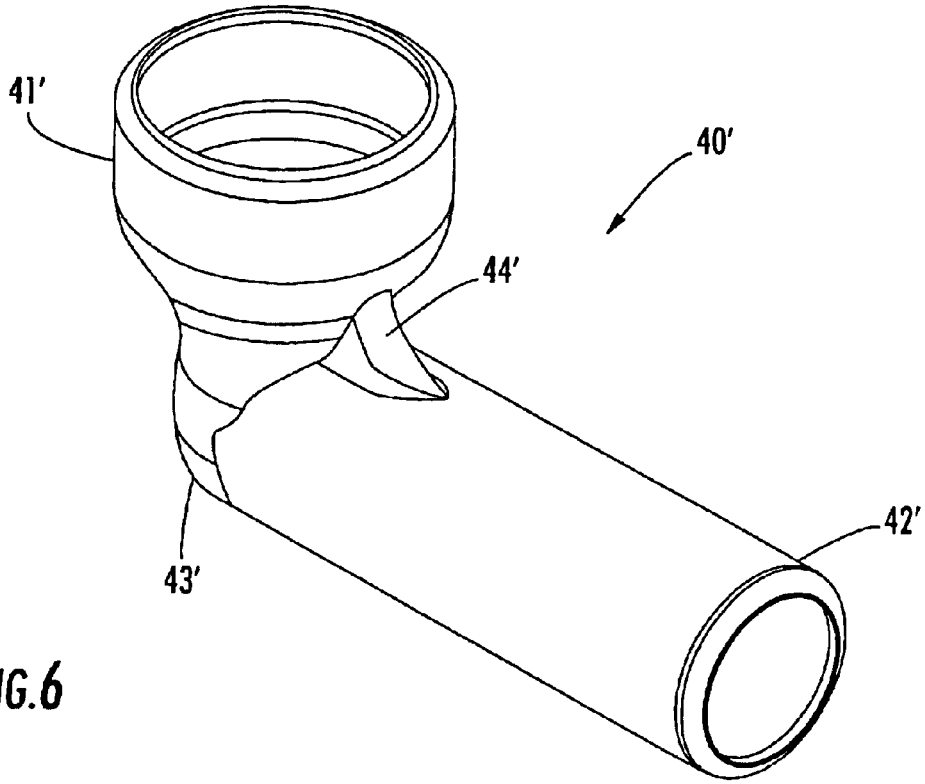
FIG. 6 is a perspective view of another embodiment of a first layer for an elbow connector of the invention.

Referring now again to FIGS. 1 and 2, and additionally to FIGS. 5 and 6, yet another aspect of the connectors relates to electrical stress that may be created at the first layer 25. As will be appreciated by those skilled in the art, the first layer 25 may have at least one predetermined property to reduce electrical stress. For example, the predetermined property may comprise a predetermined impedance profile. This impedance profile may be achieved during molding of the first layer 25 as facilitated by the use of a TPE material with additives or dopants, such as, zinc oxide, for example, that can tailor the impedance profile for electrical stress. Alternately or additionally, the predetermined property may comprise a predetermined geometric configuration as will also be appreciated by those skilled in the art.

To address the electrical stress in those connector embodiments including at least one bend, the first layer 40 may be molded or otherwise shaped to have the appearance of the embodiment shown in FIG. 5. In particular, the first layer 40 illustratively includes first and second ends 41, 42 with a bend at the medial portion 43. To reduce electrical stress at the bend, a series of spaced apart ribs 44 are provided to extend between the adjacent connector portions at the right or inner angle of the bend. Of course, the first layer 40 may be provided by molding a semiconductive TPE material as described above, but in other embodiments, this first layer 40 may be formed from other materials having the desired mechanical and electrical properties.

A second embodiment of a first layer 40' is explained with particular reference to FIG. 6. In this embodiment, the first layer 40' includes slightly differently shaped first and second ends 41', 42'. In addition, only a single rib 44' is provided at the right angle portion of the bend to reduce electrical stress thereat. The configuration of the ribs 44 or single rib 44', as well as the configuration of the other connector body portions will be dependent on the desired operating voltage and current, as will be appreciated by those skilled in the art.

Of course, these stress control techniques can be used with any of the different electrical connector embodiments described herein. Typical 200 and 600 Amp elbow connectors, for example, may benefit from such stress control techniques as will be appreciated by those skilled in the art.

Referring now additionally to FIGS. 7–10 an anti-flashover feature of an elbow connector 50 is now described. A conventional elbow connector is subject to potential flashover as the connector is removed from the bushing insert and a partial vacuum is created as the end or cuff of the connector slides over the shoulder of the bushing insert. The prior art has attempted various approaches to address this partial vacuum/flashover shortcoming.

In accordance with the illustrated connectors 50, 50', this shortcoming is addressed by the connector body 51, 51' having an outer end portion 51*a*, 51*a*' adjacent the first end 52*a*, 52*a*' of the passageway 52, 52' with a flared shape, such as when abutting the shoulder 55, 55' of an electrical bushing insert 54, 54'. In other words, the outer end 53, 53' may abut the shoulder 55, 55' without the sliding contact that would otherwise cause the partial vacuum.

In the illustrated embodiment of FIG. 7, the outer end 53 of the connector body 51 may be initially formed to have the flared shape, even when separated from the shoulder 55 of the bushing insert 54, such as when initially manufactured. Of course, in other embodiments, the outer end 53 may be sized so that it is in spaced relation from the shoulder 55 even when fully seated, as an upper end of the bushing insert may engage and lock into a corresponding recess in the passageway 22 as will be appreciated by those skilled in the art.

As illustrated in the embodiment of FIGS. 8–10, the outer end 53' initially includes a slight radius of curvature (FIG. 8) so the outer end flares outwardly upon abutting the shoulder 55' (FIGS. 9 and 10). Of course, those of skill in the art will appreciate other similar configurations as contemplated by the invention.

As also shown in the embodiment of the connector 50' of FIGS. 8–10, a series of longitudinally extending slits 56 may be provided to both facilitate the outward flaring and/or also provide at least a degree of air venting as the connector 50' is removed from the busing insert 54'. Accordingly, the likelihood of flashover is significantly reduced or eliminated. Moreover, for those embodiments using TPE materials, the outer end can be formed to be relatively thin to facilitate the flaring as described herein and as will be appreciated by those skilled in the art.

Another advantageous feature of the electrical connector 50' is now explained. As noted in the above background, in many instances it is desirable to visually indicate whether the connector is properly and fully seated onto the electrical bushing insert 54'. The illustrated embodiment of the connector 50' includes a colored band 57 serving as indicia to visually indicate to a technician that the connector has moved from the unseated position (FIG. 8) to the fully seated position (FIGS. 9 and 10). In other words, when the colored band 57 becomes fully visible to the technician viewing the connector 50' along an axis of the bushing insert 54' and first connector end 51*a'* (FIG. 10), the connector is fully seated. Conversely, in some embodiments, the outer end 53' could be configured so that, if viewed from the side, the colored band 57 would no longer be visible when properly seated. Those of skill in the art will appreciate other indicia configurations carried by the outer end of the connector 50' are contemplated by the present invention.

This indicator feature can be used, for example, for all elbows including 15, 25, 35 Kv 200 Amp devices, as well as many 600 Amp devices. Seating indicators exist in some prior art connectors, but these seating indicators are generally placed on the bushing insert. Accordingly, it may be difficult to see the indicator when the technician is positioning the elbow directly in front of the transformer. The seating indicators currently used typically employ a yellow band on the bushing that is covered up by the elbow cuff when the two portions are fully mated. After the products are mated together, the operator must view the side of the product to see if all of the yellow band is covered. In accordance with the indicator feature of the connector 50', the elbow cuff or outer end 53 will flip up or flare when fully mated so that it can be viewed when directly in front of the technician. Thus, the technician need not approach the energized equipment to view the fully latched connector.

Figure 11:
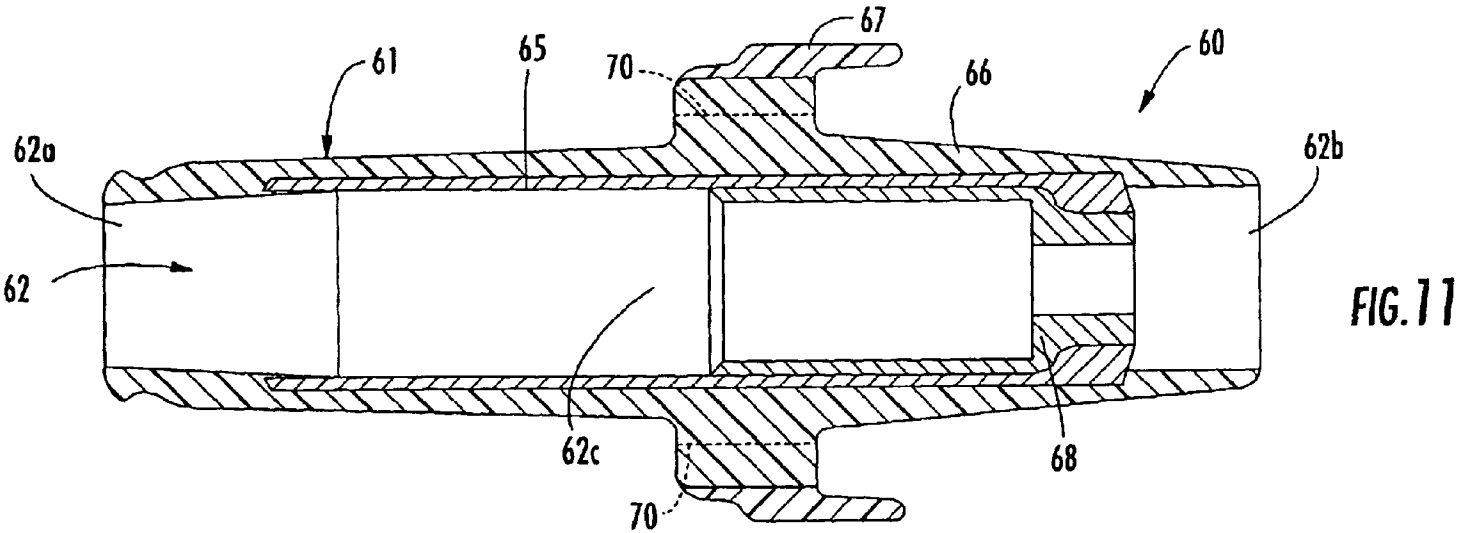
FIG. 11 is a longitudinal cross-sectional view of an embodiment of electrical bushing insert in accordance with the invention.
Figure 12:
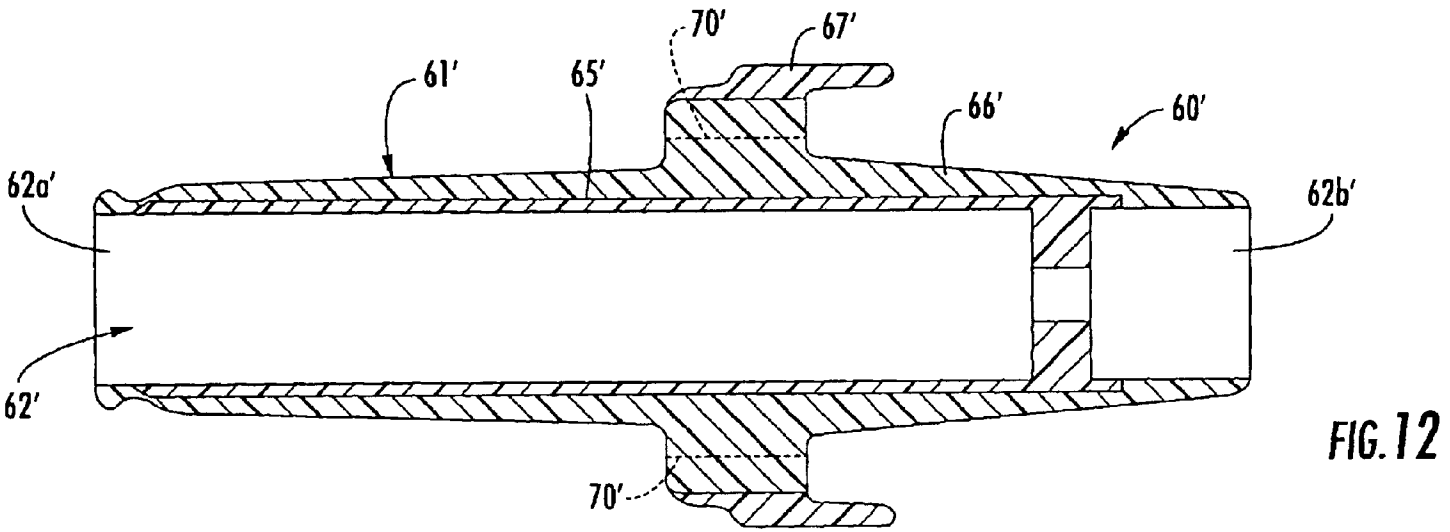
FIG. 12 is a longitudinal cross-sectional view of another embodiment of a bushing insert in accordance with the invention.
Figure 13:
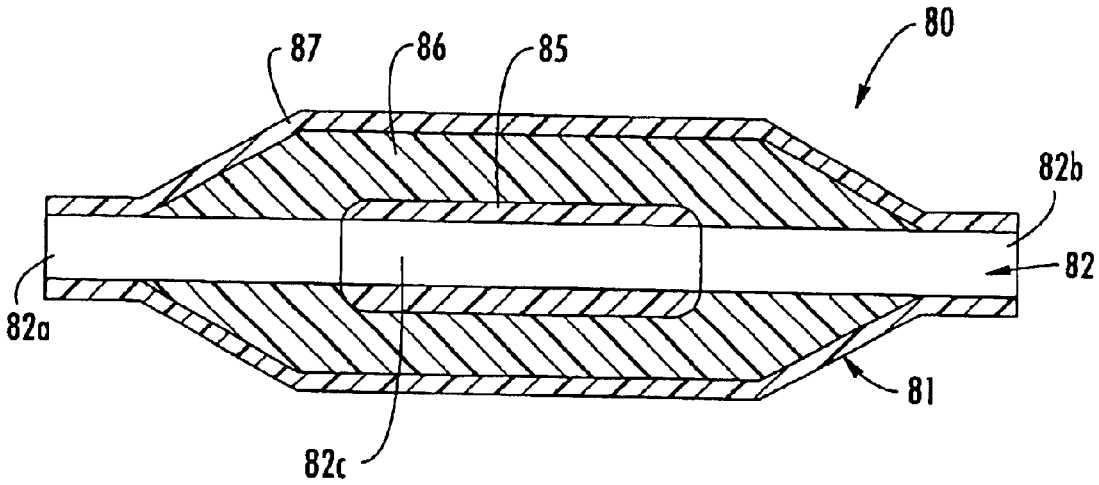
FIG. 13 is a longitudinal cross-sectional view of an electrical splice in accordance with the invention.

Referring now additionally to FIGS. 11–13 other types of connectors including the advantageous features described herein are now described. An electrical bushing insert 60 is shown in FIG. 11 and includes a connector body 61 having a tubular shape defining the passageway 62 having opposing ends 62*a*, 62*b* and a medial portion 62*c* therebetween. The connector body 61 illustratively includes a first layer 65 comprising metal, a second layer 66 comprising an insulative material and surrounding the first layer, and a third layer comprising, for example, a semiconductive material and surrounding the second layer at a medial portion of the connector body that is adjacent the medial portion of the passageway. Another metallic insert 68 is also provided in the illustrated embodiment within the passageway 62, although those of skill in the art will recognize that other materials and configurations for the conducting internal components of the bushing insert 60 are also possible.

The second and/or third layers 66, 67 may comprise TPE materials for the advantages as noted above. For example, the second layer 66 may comprise an insulative TPE material, and the third layer may comprise a semiconductive TPE material. As also shown in the illustrated embodiment, the second layer 66 may have an enlarged diameter adjacent the medial portion 62*c* of the passageway 62. Indeed this enlarged diameter medial portion may be formed by multiple layering of the insulative TPE material as indicated by the dashed lines 70', or by using other filler materials, for example, as will be appreciated by those skilled in the art. It may often be desirable to form successive relatively thin layers of the insulative TPE for the desired overall thickness and shape of the second layer 66. The first and third layers 65, 67, may also be formed of successive thinner layers in this connector embodiment, as well as the others described herein, and as will be appreciated by those skilled in the art.

A second embodiment of a bushing insert 60' is shown in FIG. 12 and now described in greater detail. In this embodiment, the first layer 65' is provided by a plastic material, such as a TPE material, for example. For example, the plastic material may be an insulative or semiconductive material. Those other elements of the bushing insert 60' are indicated by prime notation and are similar to those discussed above with reference to FIG. 11.

The rib feature described above to reduce electrical stress may also be applied to the embodiments of the bushing inserts 60, 60'. In addition, a plurality of bushing inserts 60, 60' may also be joined to a common bus bar, for example, to produce an electrical connector in the form typically called a junction as will be appreciated by those skilled in the art.

Referring now more particularly to FIG. 13, yet another electrical connector in the form of an inline splice 80 is now explained. The splice 80 illustratively includes a tubular connector body 81 defining a passageway 82 having first and second ends 82*a*, 82*b* with a medial portion 83*c* therebetween. The connector body 81 includes a first layer adjacent and/or defining the medial portion 82*c* of the passageway 82, a second layer 86 surrounding the first layer, and a third layer 87 surrounding the second layer. The first and/or third layers 65, 67 may comprise semiconductive TPE material, and the second layer 66 may comprise insulative TPE material. Accordingly, this splice 80 also enjoys the advantages and benefits provided by using TPE materials as described herein.

Other features and advantages of the present invention may be found in copending patent applications filed concurrently herewith and assigned to the assignee of the present invention and are entitled ELECTRICAL CONNECTOR WITH VISUAL SEATING INDICATOR AND ASSOCIATED METHODS, appln. 60/380,914; ELECTRICAL CONNECTOR INCLUDING SPLIT SHIELD MONITOR POINT AND ASSOCIATED METHODS, application Ser. No. 10/438,766; ELECTRICAL CONNECTOR INCLUDING THERMOPLASTIC ELASTOMER MATERIAL AND ASSOCIATED METHODS, application Ser. No. 10/438,750; and ELECTRICAL CONNECTOR WITH ANTI-FLASHOVER CONFIGURATION AND ASSOCIATED METHODS, application Ser. No. 10/438,777, the entire disclosures of which are incorporated herein in their entirety by reference. In addition, many modifications and other embodiments of the invention will come to the mind of one skilled in the art having the benefit of the teachings presented in the foregoing descriptions and the associated drawings. Accordingly, it is understood that the invention is not to be limited to the illustrated embodiments disclosed, and that other modifications and embodiments are intended to be included within the spirit and scope of the appended claims.

That which is claimed is:

1. An electrical connector comprising:

a connector body having a passageway therethrough and comprising a first layer adjacent the passageway and comprising a material having a relatively low resistivity, a second layer surrounding said first layer and comprising a material having a relatively high resistivity, and a third layer surrounding said second layer and comprising a material having a relatively low resistivity, at least one of said first, second and third layers comprising a thermoplastic elastomer (TPE) material; and a cold shrink core positioned within at least a portion of the passageway.

2. An electrical connector according to claim 1 wherein said cold shrink core comprises a carrier and a release member connected thereto so that said carrier maintains adjacent connector body portions in an expanded state until said release member is activated.

3. An electrical connector according to claim 1 wherein the passageway has first and second ends; and wherein said cold shrink core is positioned within at least one of the first and second ends of the passageway.

4. An electrical connector according to claim 1 wherein the passageway has first and second ends; and wherein said cold shrink core is positioned within only the second end of the passageway.

5. An electrical connector according to claim 1 wherein said second layer comprises an insulative TPE material.

6. An electrical connector according to claim 1 wherein each of said first and third layers comprises a semiconductive TPE material.

7. An electrical connector according to claim 1 wherein the passageway has first and second ends and a medial portion extending therebetween; and wherein said first layer is positioned along the medial portion of the passageway and is spaced inwardly from respective ends thereof.

8. An electrical connector according to claim 7 wherein the medial portion of the passageway has a bend therein.

9. An electrical connector according to claim 8 wherein said first layer comprises at least one outwardly extending rib adjacent the bend of the passageway to reduce electrical stress.

10. An electrical connector according to claim 8 wherein the first end of the passageway has an enlarged diameter to receive an electrical bushing insert therein.

11. An electrical connector according to claim 7 wherein said connector body has a tubular shape defining the passageway.

12. An electrical connector according to claim 11 wherein said second layer has an enlarged diameter adjacent the medial portion of the passageway.

13. An electrical connector according to claim 1 wherein said connector body adjacent at least one of the first and second ends of the passageway has a progressively increasing outer diameter.

14. An electrical connector according to claim 1 wherein said connector body adjacent at least one of the first and second ends of the passageway body has a progressively decreasing outer diameter.

15. An electrical connector according to claim 1 wherein said first layer has at least one predetermined property to reduce electrical stress thereon.

16. An electrical connector according to claim 1 wherein said first layer defines an innermost layer; and wherein said third layer defines an outermost layer.

17. An electrical connector according to claim 1 further comprising at least one pulling eye carried by said connector body.

18. An electrical connector according to claim 1 wherein said connector body is configured for at least 15 KV and 200 Amp operation.

19. An electrical connector according to claim 1 wherein each of said first and third layers has a resistivity less than about $10^8$ Ω·cm; and wherein said third layer has a resistivity greater than about $10^8$ Ω·cm.

20. An electrical connector comprising:

a connector body having a passageway therethrough, the passageway having first and second ends and a medial portion with at least one bend therein between the first and second ends, the first end of the passageway having an enlarged diameter to receive an electrical bushing insert therein, said connector body comprising a first layer adjacent the bend and spaced inwardly from the first and second ends of the passageway, a second layer surrounding said first layer and comprising an insulative thermoplastic elastomer (TPE) material, and a third layer surrounding said second layer and comprising a semiconductive TPE material, a cold shrink core positioned within the second end of the passageway.

21. An electrical connector according to claim 20 wherein said cold shrink core comprises a carrier and a release member connected thereto so that said carrier maintains adjacent connector body portions in an expanded state until said release member is activated.

22. An electrical connector according to claim 20 wherein said first layer comprises a semiconductive TPE material.

23. An electrical connector according to claim 20 wherein said second layer comprises at least one outwardly extending rib adjacent the bend of the passageway to reduce electrical stress.

24. An electrical connector according to claim 20 wherein said first layer has at least one predetermined property to reduce electrical stress thereon.

25. An electrical connector according to claim 20 wherein said first layer defines an innermost layer; and wherein said third layer defines an outermost layer.

26. An electrical connector according to claim 20 further comprising at least one pulling eye carried by said connector body.

27. An electrical connector according to claim 20 wherein said connector body is configured for at least 15 KV and 200 Amp operation.

28. An electrical connector according to claim 20 wherein each of said first and third layers has a resistivity less than about $10^8$ Ω·cm; and wherein said third layer has a resistivity greater than about $10^8$ Ω·cm.

29. A method for making an electrical connector body having a passageway therethrough, the method comprising:

providing a first layer to define at least a medial portion of the passageway;

overmolding a second layer surrounding the first layer and comprising an insulative thermoplastic elastomer (TPE) material having a relatively high resistivity;

overmolding a third layer surrounding the second layer and comprising a material having a relatively low resistivity; and positioning a cold shrink core within at least a portion of the passageway to make the electrical connector body.

30. A method according to claim 29 wherein the cold shrink core comprises a carrier and a release member connected thereto so that the carrier maintains adjacent connector body portions in an expanded state until the release member is activated.

31. A method according to claim 29 wherein the passageway has first and second ends; and wherein positioning the cold shrink core comprises positioning the cold shrink core within at least one of the first and second ends of the passageway.

32. A method according to claim 29 wherein the passageway has first and second ends; and wherein positioning the cold shrink core comprises positioning the cold shrink core within only the second end of the passageway.

33. A method according to claim 29 wherein each of the first and third layers comprises a semiconductive TPE material.

34. A method according to claim 29 wherein providing the first layer comprises molding the first layer from a semiconductive TPE material.

35. A method according to claim 29 wherein overmolding the second and third layers comprises overmolding the second and third layers so that the first layer is positioned along the medial portion of the passageway and is spaced inwardly from respective ends thereof.

36. A method according to claim 35 wherein the medial portion of the passageway has a bend therein.

37. A method according to claim 35 wherein providing the first layer and overmolding the first and second layers defines the connector body to have a tubular shape defining the passageway.

38. A method according to claim 29 wherein providing the first layer comprises providing the first layer to have at least one predetermined property to reduce electrical stress thereon.

39. A method according to claim 29 wherein the first layer defines an innermost layer; and wherein the third layer defines an outermost layer.

40. A method according to claim 29 wherein the connector body is configured for at least 15 KV and 200 Amp operation.

41. A method according to claim 29 wherein each of the first and third layers has a resistivity less than about $10^8$ Ω·cm; and wherein the third layer has a resistivity greater than about $10^8$ Ω·cm.

* * * * *

UNITED STATES PATENT AND TRADEMARK OFFICE

CERTIFICATE OF CORRECTION

PATENT NO. : 6,796,820 B2
DATED : September 28, 2004
INVENTOR(S) : Jazowski et al.

It is certified that error appears in the above-identified patent and that said Letters Patent is hereby corrected as shown below:

Title page,
Item [56], References Cited, U.S. PATENT DOCUMENTS, insert
-- 3,515,798 6/20/70 Sievert
5,226,837 7/13/93 Cinibulk et al 439/521
6,688,921 2/10/04 Borgstrom et al. 439/798 --

Column 10,
Line 27, delete "60/380,914" insert -- 10/438,764 --

Signed and Sealed this

Third Day of May, 2005

JON W. DUDAS
*Director of the United States Patent and Trademark Office*